US008851868B2

(12) United States Patent
Stones et al.

(10) Patent No.: US 8,851,868 B2
(45) Date of Patent: Oct. 7, 2014

(54) SCROLL COMPRESSOR INCLUDING FLOW PATH WITH DIFFERING AXIAL EXTENTS

(75) Inventors: Ian David Stones, Burgess Hill (GB); Alan Ernest Kinnaird Holbrook, Pulborough (GB)

(73) Assignee: Edwards Limited, Crawley (GB)

( * ) Notice: Subject to any disclaimer, the term of this patent is extended or adjusted under 35 U.S.C. 154(b) by 0 days.

(21) Appl. No.: 13/320,511

(22) PCT Filed: Jun. 23, 2010

(86) PCT No.: PCT/GB2010/051042

§ 371 (c)(1), (2), (4) Date: Nov. 14, 2011

(87) PCT Pub. No.: WO2011/007157

PCT Pub. Date: Jan. 20, 2011

(65) Prior Publication Data

US 2012/0100026 A1 Apr. 26, 2012

(30) Foreign Application Priority Data

Jul. 14, 2009 (GB) ..... 0912162.5

(51) Int. Cl.

| | |
|---|---|
| ***F03C 2/00*** | (2006.01) |
| ***F03C 4/00*** | (2006.01) |
| ***F04C 18/02*** | (2006.01) |
| ***F04C 23/00*** | (2006.01) |

(52) U.S. Cl.

CPC ..... *F04C 18/0215* (2013.01); *F04C 18/0284* (2013.01); *F04C 23/008* (2013.01); *F04C 18/0276* (2013.01)

USPC ..... 418/55.2; 418/15; 418/55.1

(58) Field of Classification Search

USPC ..... 418/55.1–55.6, 57, 15

See application file for complete search history.

(56) References Cited

U.S. PATENT DOCUMENTS

| | | | | |
|---|---|---|---|---|
| 4,457,674 | A * | 7/1984 | Kawano et al. | 418/55.2 |
| 7,537,440 | B2 * | 5/2009 | Goodwin et al. | 418/15 |
| 2006/0228244 | A1 | 10/2006 | Goodwin et al. | |
| 2007/0212246 | A1 | 9/2007 | Jeong et al. | |

FOREIGN PATENT DOCUMENTS

| | | | |
|---|---|---|---|
| EP | 0077214 | A1 | 4/1983 |
| EP | 1205665 | A2 | 5/2002 |
| JP | 6101666 | A | 9/1992 |
| JP | 06101666 | A | 4/1994 |
| JP | 2006312898 | A | 11/2006 |
| WO | 2005019651 | A1 | 3/2005 |

OTHER PUBLICATIONS

Translation of Office Action from counterpart Chinese Patent Application No. 201080031542.5, dated Jan. 28, 2014, 11 pp.

(Continued)

*Primary Examiner* — Theresa Trieu

(74) *Attorney, Agent, or Firm* — Shumaker & Sieffert, P.A.

(57) ABSTRACT

A scroll compressor includes two scrolls 40, 46 having respective scroll plates 42, 48 and respective scroll walls 44, 50. The scroll walls intermesh so that on relative orbital movement of the scrolls, a volume 52, 54 of gas is trapped between the scrolls and pumped from an inlet 31 to an outlet 33. The axial extent 'A' of the trapped volume between the scroll plates is less along a first portion 62 of a flow path 56 between the inlet and the outlet than the axial extent 'B' of the trapped volume along a second portion 64 of the flow path, and the first portion is closer to the inlet than the second portion along the flow path.

12 Claims, 3 Drawing Sheets

(56) References Cited

OTHER PUBLICATIONS

Translation of the Notification of Reason for Rejection from corresponding Japanese application No. 2012-520096, dated Feb. 27, 2014, 5 pp.

EP Communication pursuant to Article 94(3) EPC dated Dec. 19, 2013 in corresponding EP Application No. 10735064.7, 5 pgs.

* cited by examiner

SCROLL COMPRESSOR INCLUDING FLOW PATH WITH DIFFERING AXIAL EXTENTS

The present invention relates to a scroll compressor.

A prior art scroll compressor, or pump, 10 is shown in FIG. 5, and comprises a housing 12, a drive shaft 14 having a concentric shaft portion 16 and an eccentric shaft portion 18. The shaft 14 is supported at its concentric portion by bearings 20, which are fixed relative to housing 12, and driven by a motor 22. Second bearings 24 support an orbiting scroll 26 on the eccentric shaft portion 18 so that during use rotation of the shaft imparts an orbiting motion to the orbiting scroll 26 relative to a fixed scroll 28 for pumping fluid along a fluid flow path 30 between an inlet 31 and outlet 33 of the compressor.

Each scroll comprises a scroll wall 32, 34 which extends perpendicularly to a generally circular base plate 27, 29. The orbiting scroll wall 32 co-operates, or meshes, with the fixed scroll wall 34 during orbiting movement of the orbiting scroll. Relative orbital movement of the scrolls causes a volume of gas to be trapped between the scrolls and pumped from the inlet to the outlet.

Scroll pumps are dry pumps and therefore the clearances between the scroll walls 32, 34 must be accurately set during manufacture or adjustment to minimize seepage of fluid through the clearances. The space between the axial ends of a scroll wall of one scroll and the base plate of the other scroll is sealed by tip seals 36.

The capacity, or pumping speed, of a scroll pump is determined by the volume of gas which can be trapped between the scrolls. The compression limit of a pump is a function of the amount of back leakage (determined by the seal effectiveness) and the pumping capacity which serves to pump away the leaks. As the capacity of a scroll pump is reduced, the amount of leakage which can be pumped away also reduces resulting in lower compression.

To meet certain requirements, it is desirable to provide a scroll pump with reduced pumping capacity but without reduced compression.

The present invention provides an improved scroll compressor.

The present invention provides a scroll compressor comprising two scrolls having respective scroll plates and respective scroll walls, the scroll walls intermeshing so that on relative orbital movement of the scrolls a volume of gas is trapped between the scrolls and pumped from an inlet to an outlet wherein the axial extent of said trapped volume between said scroll plates is less along a first portion of a flow path between the inlet and the outlet than the axial extent of said trapped volume along a second portion of the flow path, and wherein the first portion is closer to the inlet than the second portion along the flow path.

Other preferred and/or optional aspects of the invention are defined in the accompanying claims.

In order that the present invention may be well understood, two embodiments thereof, which are given by way of example only, will now be described with reference to the accompanying drawings, in which.

The general arrangement of one scroll pump has been described above in relation to FIG. 5 and will not be described again for the sake of brevity. FIGS. 1 to 4 show aspects of the scroll pump which have been modified from the pump shown in FIG. 5.

Figure 1:
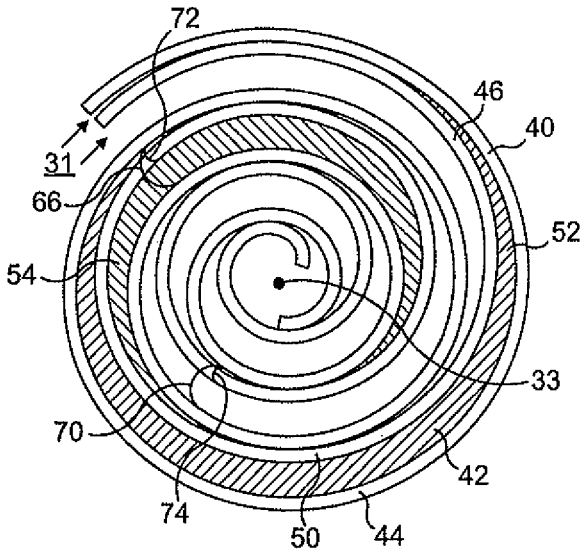
FIG. 1 shows a schematic view of the scroll walls of a scroll pump.
Figure 2:
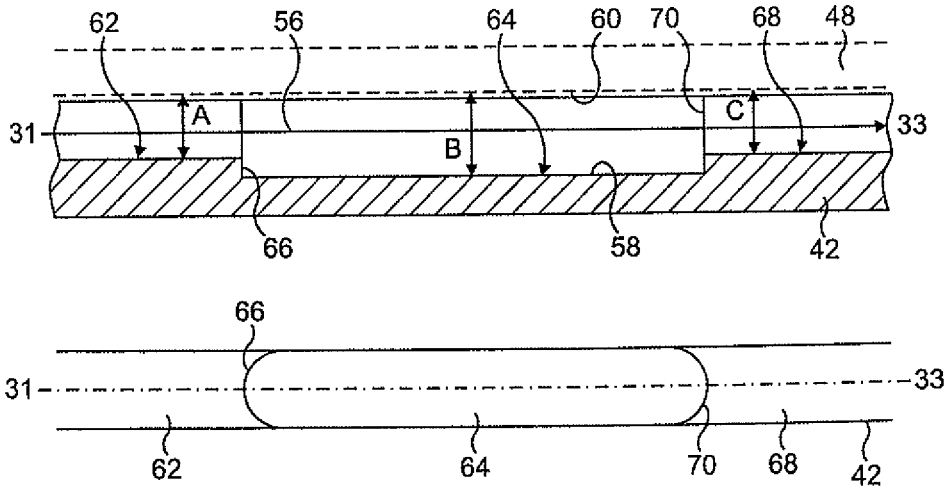
FIG. 2 is a section through a scroll plate of the fixed scroll of the pump according to FIG. 1.

Referring to FIGS. 1 and 2, a scroll compressor comprises a fixed scroll 40 having a fixed scroll plate 42 and a fixed scroll wall 44 and an orbiting scroll 46 having an orbiting scroll plate 48 and an orbiting scroll wall 50. The scroll walls 44, 50 intermesh so that on relative orbital movement of the scrolls a volume 52 of gas is trapped between the scrolls and pumped from the inlet 31 to the outlet 33. A second volume 54 of gas is trapped between the scrolls on another side of the scroll wall of the orbiting scroll and is pumped from the inlet to the outlet along a flow path. The double arrow at the inlet 31 indicates that fluid is pumped on both sides of the orbiting scroll to the outlet. The volumes 52, 54 are generally crescent-shaped and, as shown in FIG. 1 when viewed from an axial direction, reduce in size from the inlet to the outlet achieving compression.

Figure 5:
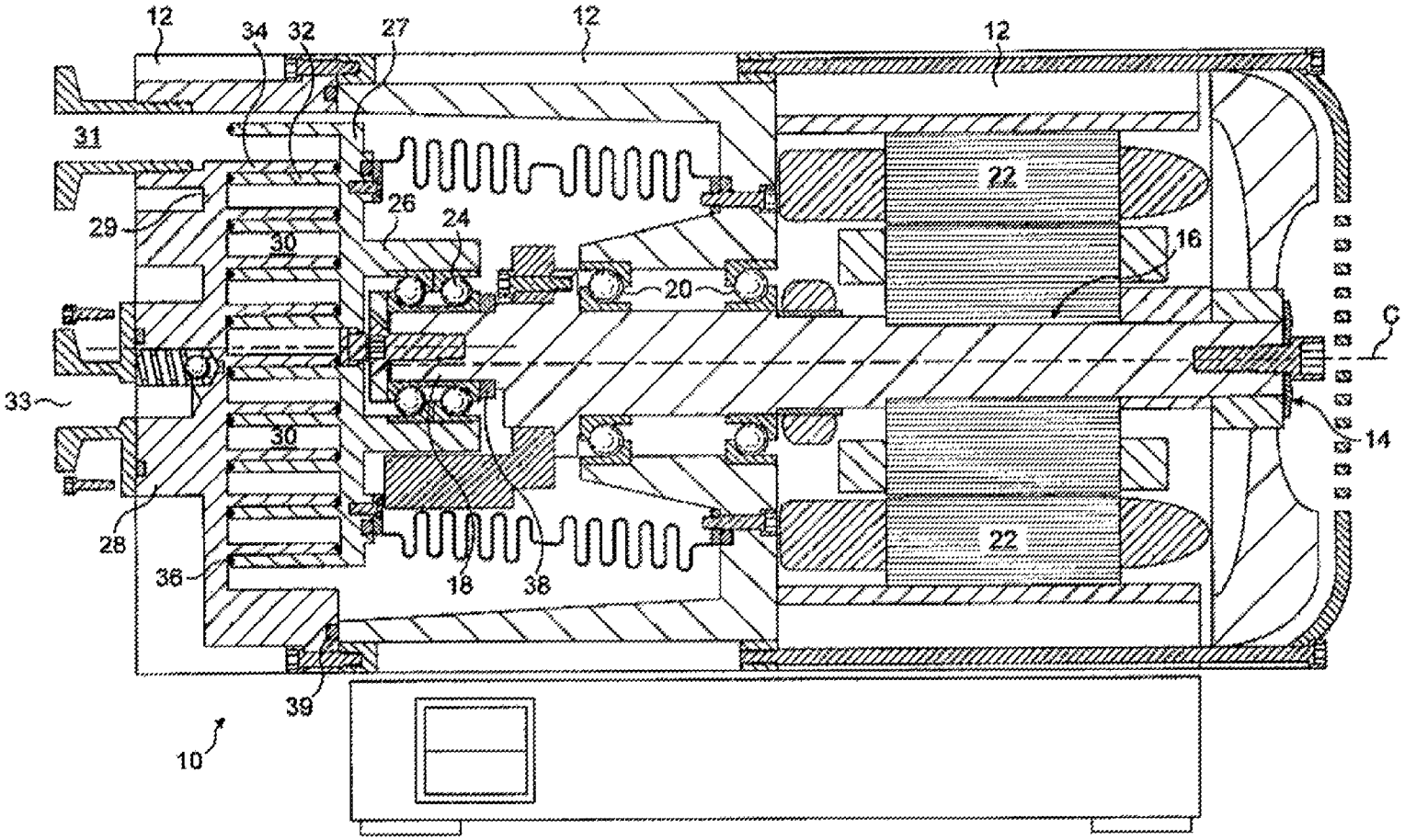
FIG. 5 PRIOR ART
FIG. 5 shows a section through a prior art scroll compressor.

As compared to the scroll pump shown in FIG. 5, the pumping capacity of the scroll pump according to FIGS. 1 and 2 is reduced. In this regard, volumetric capacity of the first wrap (i.e. the first 360° extending from the inlet) is selected to meet pumping capacity requirements whilst the capacity of the remaining wraps is selected to compression requirements. Since different pumping capacities are often required in different pumping applications, the pump described with reference to FIGS. 1 and 2 can be readily modified as shown to meet reduced pumping capacity, whilst maintaining an existing layout and components and without a loss in compression. It would not normally be expected that a pump would be designed specifically to reduce pump performance and yet with customers increasing requirements for a range of pumping capacities the present invention allows a large range of pumps to be provided with different pumping capacities and good compression and without the requirement for multiple pump layouts and designs.

FIG. 2 shows a section through the fixed scroll plate 42 with its line of section corresponding to an involute between the inlet and the outlet and extending approximately mid-way between successive wraps of the fixed scroll wall. In other words, the involute channel formed by the fixed scroll has been unwrapped in FIG. 2 with the inlet 31 on the left in the Figure and the outlet 33 on the right. The position of the orbiting scroll plate 48 is shown in broken lines. The scroll walls 44, 50 are not shown for simplicity. A plan view of the fixed scroll channel is also shown.

As shown in FIG. 2, relative orbiting motion of the scrolls causes a volume 52, 54 to be trapped between the scrolls and pumped along a flow path 56 extending from the inlet 31 to the outlet 33. The axial extent, or depth, of the volume 52, 54 is defined by the facing surfaces 58, 60 of the scroll plates. A first portion 62 of the flow path is closer to the inlet than the second portion along the flow path and the axial extent of the trapped volume along the first portion is less than the axial extent of the trapped volume along the second portion. The axial extent 'A' of trapped volume is different along a first portion 62 of the flow path 56 from the axial extent 'B' of the trapped volume along a second portion 64 of the flow path. Accordingly, it is possible to change the volumetric capacity of the pump by selecting the appropriate axial extent of the trapped volume at different portions of the flow path 56.

In order to form the change in axial extent or depth the scroll plate of the fixed scroll comprises an axial step 66 between the first and second portions of the flow path 56 thereby increasing or decreasing the axial extent of the trapped volume at the axial step. Alternatively or additionally, an axial step may be formed in the orbiting scroll plate 48.

If as shown it is desired to reduce pumping capacity but retain pump compression, then the axial extent 'A' of the trapped volume along the first portion 62 is selected to be less than the axial extent 'B' of the trapped volume along the second portion 64, since the first portion 62 of the flow path is closer to the inlet 31 than the second portion 64. Accordingly, the axial extent (or depth) and volumetric capacity of the pumping channel is less at the inlet and greater towards the outlet changing in this example by one discrete step 66. The deeper channel along the second portion 64 allows the pump to retain compression as compared to the prior art thereby providing a pump with reduced capacity but without reduced compression.

The axial extent 'C' of the trapped volume along a third portion 68 of the flow path 56 may be different from the axial extent 'A' or 'B' of the trapped volume along at least one of the first portion 62 and the second portion 64. As shown FIGS. 1 and 2, the second portion 64 is between the first portion 62 and the third portion 68 along the flow path and the axial extent 'B' of the trapped volume along the second portion is less than the axial extent of the trapped volume along the first portion and the second portion. In this way, the first portion 62 reduces pumping speed (or capacity), the second portion 64 retains compression and the third portion 68 with decreased depth reduces power consumption. In order to form the change in depth the scroll plate of the fixed scroll comprises an axial step 70 between the third and second portions of the flow path 56 thereby changing the axial extent of the trapped volume at the axial step. Alternatively or additionally, an axial step may be formed in the orbiting scroll plate 48.

It should be noted that a step change in the depth of the channel will itself cause a small loss in compression. Accordingly, in the example shown in FIG. 1, the depth of the second portion should be sufficient to compensate for such losses.

As shown in FIG. 1, coincident with the axial steps 66, 70 in the fixed scroll plate 42 are respective axial steps 72, 74 in the orbiting scroll wall 50. In this regard, at the locations where the depth of the fixed scroll channel is increased or decreased, the height of the orbiting scroll wall is decreased or increased commensurately. Each discrete portion of the orbiting scroll performs an orbiting motion relative to the fixed scroll. Therefore, the step in the fixed scroll plate is arcuate and preferably circular so that the orbiting scroll wall sweeps across the face of the fixed scroll plate during its orbiting motion and the clearance therebetween is retained relatively small throughout the orbiting motion. Preferably, as shown, the steps in the orbiting scroll wall are also arcuate and preferably circular so that the clearance is kept to a minimum throughout the orbiting motion. In this way, the scroll walls are shaped so that leakage at the steps is minimised.

The scrolls of a second scroll pump are described with reference to FIGS. 3 and 4. Like reference numerals used in relation to FIGS. 1 and 2 are used to denote like features of the scroll compressor described with reference to FIGS. 3 and 4. The scrolls of the second scroll pump define a multi-start arrangement in which dissimilar pumping is applied to fluid entering the pump through one or more inlets. For example, an inlet may be provided at a location which is part way between inlet 31 at a radially outer portion of the scrolls and the outlet 33 at a radially inner portion of the scrolls. Such a further inlet may provide an intermediate, or booster, inlet for pumping at a pressure between the inlet 31 and the outlet 33.

Figure 3:
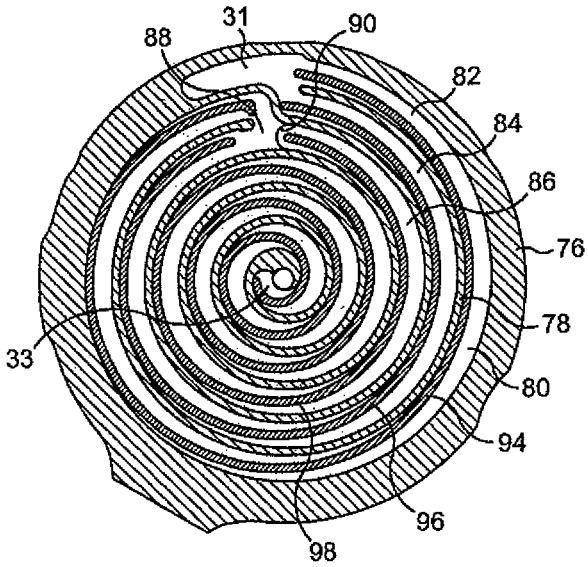
FIG. 3 shows a schematic view of the scroll walls of another scroll pump.

As shown in FIG. 3, the fixed scroll 76 comprises a fixed scroll wall 78 and a fixed scroll plate 80 arranged to form two channels 82, 84 extending from the inlet 31. The channels converge to form a single channel 86 which extends to the outlet 33 thereby providing a multi-start flow path between the inlet and the outlet. That is, the first portions of the flow paths (having a first axial extent or depth) extend along the channels 82, 84 and the second portion of the flow paths (having a second axial extent or depth) extends along the single channel 86.

The multiple starts may be synchronised (side-by-side) as shown in FIG. 3, in which case the channels can be converged to form fewer channels. Typically, two or more channels may converge to form one channel. In FIG. 3, the channels 82, 84 converge to form channel 86 at a location 88 where the axial extent, or depth, of the channel increases. Accordingly, the axial extent 'A' of the trapped volume between the scrolls along the channels 82, 84 is less than the axial extent 'B' of the trapped volume along the single channel 86.

Figure 4:
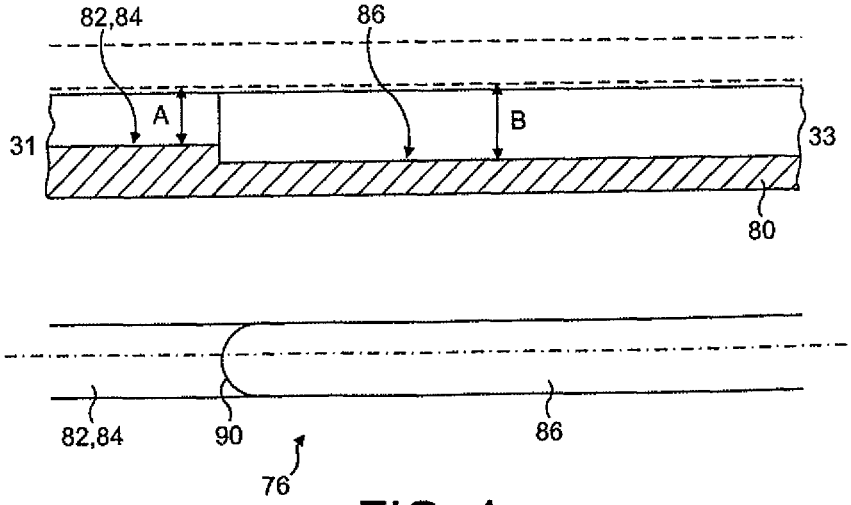
FIG. 4 is a section through a scroll plate of the fixed scroll of the pump according to FIG. 3.

FIG. 4 shows a view similar to FIG. 2. A section through the fixed scroll plate 76 is shown with its line of section corresponding to a multi-start involute between the inlet 31 and the outlet 33 and extending approximately mid-way between successive wraps of the fixed scroll wall. For the sake of simplicity, the channels 82, 84 are shown by one section in FIG. 4, although it will be appreciated that channels 82, 84 are separate. A plan view of the fixed scroll channel is also shown.

The stepped wall 90 and the multi-start arrangement introduce unsealed regions into the pump's mechanism. However, the convergence 88 of the channels and the stepped portion 90 are located in approximately the same position in the pump and therefore the efficiency losses from leakage are the same as for a single unsealed region. Therefore, efficiency losses are minimised. In other words, a multi-start arrangement causes a loss in efficiency because as shown in FIG. 3 there is a break in the scroll walls at the convergence. Whilst the stepped wall 90 also introduces a small inefficiency, the increased depth of pumping channel along channel 86 compensates for the loss of efficiency due to the multi-start arrangement.

The combination of a multi-start arrangement and a stepped wall provides the opportunity to design any compression ratio greater than unity, without the inlet being deeper than the downstream depth 'B'. The addition of a shallow inlet to a multi-start arrangement improves the pumping efficiency where the channels converge. For example, a compression ratio of 1.7 would be more efficient than a compression ratio of 2.0.

Referring to FIG. 3, the orbiting scroll wall of the orbiting scroll comprises two generally parallel circular sections 94, 96 disposed in respective channels 82, 94 and a single involute wall section 98 disposed in the single channel 86 of the fixed scroll.

In order to reduce leakage in the scroll compressors described, the scroll walls have respective seals at axial ends thereof which seal against the opposing scroll plate.

As shown in FIGS. 1 to 4, the first 62; 82, 84, second 64; 86 or third 68 portions along the flow path extend through at least 360° of the flow path or paths. For example, referring to FIG. 1, a crescent-shaped pocket extends through less than 360° and therefore first portion extends through at least 360° so that a pocket is not open to both the inlet 31 and the stepped portion 66 at the same time.

Whilst a scroll compressor is typically operated for pumping fluid, instead it can be operated as a generator for generating electrical energy when pressurised fluid is used to rotate the orbiting scroll relative to the fixed scroll. The present invention is intended to cover use of the scroll compressor for pumping and energy generation.

The invention claimed is:

1. A multi-start scroll compressor comprising:

a first scroll being one of a fixed scroll and an orbiting scroll; and a second scroll being the other of the fixed scroll and the orbiting scroll, wherein the first scroll comprises a first scroll plate and a first scroll wall arranged to define a flow path including a first portion in which the first scroll plate and first scroll wall define a plurality of substantially parallel channels that extend from an inlet and converge at a second portion in which the first scroll plate and the first scroll wall define a single channel extending to an outlet, and wherein the second scroll comprises a second scroll plate and second scroll wall intermeshing with the first scroll wall of the first scroll so that on relative orbital movement of the first and second scrolls, a volume of gas is trapped between the first and second scrolls and pumped in parallel through the plurality of substantially parallel channels along the first portion of the flow path from the inlet to converge at the second portion and be pumped along the second portion of the flow path to the outlet, and wherein an axial extent of the trapped volume between the first and second scroll plates is less along the first portion of the flow path than the axial extent of the trapped volume along the second portion of the flow path.

2. The multi-start scroll compressor of claim 1, wherein the axial extent of the trapped volume along a third portion of the flow path is different from the axial extent of the trapped volume along at least one of the first portion and the second portion.

3. The multi-start scroll compressor of claim 2, wherein the second portion is between the first portion and the third portion along the flow path and the axial extent of the trapped volume along the second portion is greater than the respective axial extents of the trapped volume along the first portion and the third portion.

4. The multi-start scroll compressor of claim 1, wherein the first scroll plate comprises an axial step between the first portions and the second portion of the flow path thereby increasing the axial extent of the trapped volume at the axial step.

5. The multi-start scroll compressor of claim 4, wherein the axial step comprises a first axial step, and wherein the first axial step coincides with a second axial step in the second scroll plate.

6. The multi-start scroll compressor of claim 4, wherein the axial step is arcuate.

7. The multi-start scroll compressor of claim 1, wherein the first and second scroll walls have respective seals at axial ends thereof which seal against the opposing scroll plate.

8. The multi-start scroll compressor of claim 1, wherein the first and second portions extend through at least 360° of the flow path.

9. The multi-start scroll compressor of claim 1, wherein the first portion extends from the inlet to a convergence, and wherein the second portion extends from the convergence to the outlet.

10. The multi-start scroll compressor of claim 9, wherein the first scroll plate comprises an axial step at the convergence thereby increasing the axial extent of the trapped volume at the axial step.

11. The multi-start scroll compressor of claim 10, wherein the axial step coincides with a gap between the two generally parallel circular sections and the single involute wall section of the orbiting scroll wall.

12. The multi-start scroll compressor of claim 1, wherein the inlet comprises a plurality of inlets.

* * * * *